US010149550B1

(12) United States Patent
Bain

(10) Patent No.: US 10,149,550 B1
(45) Date of Patent: Dec. 11, 2018

(54) LIGHTED BABY CHANGING PAD

(71) Applicant: Adam Bain, Monrovia, CA (US)

(72) Inventor: Adam Bain, Monrovia, CA (US)

(73) Assignee: Adam Bain Games, LLC, Monrovia, CA (US)

( * ) Notice: Subject to any disclaimer, the term of this patent is extended or adjusted under 35 U.S.C. 154(b) by 399 days.

(21) Appl. No.: 14/921,163

(22) Filed: Oct. 23, 2015

Related U.S. Application Data

(60) Provisional application No. 62/068,121, filed on Oct. 24, 2014.

(51) Int. Cl.

| | |
|---|---|
| ***A47D 5/00*** | (2006.01) |
| ***F21V 33/00*** | (2006.01) |
| ***F21V 23/02*** | (2006.01) |
| *F21W 131/301* | (2006.01) |

(52) U.S. Cl.
CPC ..... *A47D 5/00* (2013.01); *F21V 23/023* (2013.01); *F21V 33/0012* (2013.01); *F21W 2131/301* (2013.01)

(58) Field of Classification Search
CPC . A47G 9/06; A47G 9/062; A47G 9/02; A47G 9/0207; A47G 9/0223; A47G 9/0238; A47G 27/0212; A47D 5/00; A47D 5/006; A47D 9/00; A47D 9/005; A47D 13/00; A47D 13/06; A47D 13/061; A47D 13/08; A47D 13/083; A47D 15/00; A47D 15/001; A47D 15/003; F21V 33/0012; F21W 2121/00; F21W 2131/301; A47B 2220/0077
USPC .... 5/655, 652, 420, 417, 502, 482; 362/127, 362/130, 145, 801
See application file for complete search history.

(56) References Cited

U.S. PATENT DOCUMENTS

| | | | | |
|---|---|---|---|---|
| 2,290,866 | A | 7/1942 | Cunard | |
| 4,220,984 | A | 9/1980 | Truher et al. | |
| 4,737,764 | A | 4/1988 | Harrison | |
| 4,841,587 | A | 6/1989 | Carter et al. | |
| 4,972,533 | A * | 11/1990 | Brown | A47G 9/0207 362/800 |
| 5,278,734 | A | 1/1994 | Ferber | |
| 5,848,830 | A * | 12/1998 | Castle | A47G 27/0243 362/253 |
| 5,971,761 | A * | 10/1999 | Tillman, Sr. | G09B 5/06 434/159 |
| 6,125,487 | A | 10/2000 | Ive | |
| D436,281 | S | 1/2001 | Thompson | |
| 6,417,778 | B2 | 7/2002 | Blum et al. | |

(Continued)

FOREIGN PATENT DOCUMENTS

| | | | |
|---|---|---|---|
| GB | 2399749 | A | 9/2004 |
| GB | 2495759 | A | 4/2013 |

*Primary Examiner* — Robert G Santos
(74) *Attorney, Agent, or Firm* — Fox Rothschild LLP

(57) ABSTRACT

A lighted pad for the purpose of changing a baby's diaper in a dark room with no additional lighting including a top, body contacting translucent layer, a lighting element device layer positioned below the top, body contacting layer, the lighting element device layer including at least one lighting element powered by a portable power source, and a bottom lighting element support layer positioned below the lighting element layer such that the at least one lighting element is encapsulated between the top and bottom layers.

19 Claims, 20 Drawing Sheets

(56) References Cited

U.S. PATENT DOCUMENTS 6,481,877 B1 * 11/2002 Bello, Jr. ..... B60N 3/042 362/153
6,718,576 B1 * 4/2004 Shih ..... B60N 3/042 362/488
6,928,235 B2 8/2005 Pollack
6,940,418 B2 9/2005 Blum et al.
7,117,552 B2 10/2006 Hoffman
7,302,724 B2 12/2007 Solomon et al.
7,305,728 B2 12/2007 Schliepes
7,311,418 B2 12/2007 Zeller et al.
7,520,633 B2 * 4/2009 Hornsby ..... A47B 97/00 362/231
7,670,026 B1 * 3/2010 Hawkins ..... A47G 27/0212 362/153
7,810,181 B2 10/2010 Brewin et al.
7,825,822 B2 * 11/2010 Hornsby ..... A47B 97/00 340/12.33
7,870,625 B2 1/2011 Omar
7,905,645 B2 * 3/2011 Batti ..... A47G 27/0243 362/234
8,206,002 B1 * 6/2012 Olson ..... B25H 5/00 280/32.6
8,231,260 B2 7/2012 Chien
8,400,300 B2 3/2013 Oleen
8,777,311 B1 7/2014 Laurel, Jr.
8,851,701 B2 10/2014 Van Herpen
9,068,720 B2 * 6/2015 Mangus ..... F21V 15/01
2004/0082261 A1 4/2004 Bapst et al.
2004/0177446 A1 9/2004 Robb et al.
2005/0102752 A1 * 5/2005 Abraham ..... A47G 9/0207 5/482
2005/0172411 A1 8/2005 Snedeker
2005/0278856 A1 12/2005 Welch
2006/0163236 A1 7/2006 Mazon et al.
2006/0221599 A1 * 10/2006 Hornsby ..... A47B 97/00 362/127
2006/0262529 A1 * 11/2006 Hornsby ..... A47B 97/00 362/231
2007/0266498 A1 11/2007 Lord et al.
2008/0020672 A1 1/2008 Osborn
2008/0116401 A1 5/2008 Rice et al.
2008/0143155 A1 6/2008 Arnold et al.
2009/0016054 A1 1/2009 Chien
2009/0126139 A1 * 5/2009 Batti ..... A47G 27/0243 15/216
2009/0253342 A1 10/2009 Oren et al.
2009/0284960 A1 11/2009 Chien
2011/0296612 A1 12/2011 Papp et al.
2012/0188451 A1 7/2012 Schmidt et al.
2012/0327634 A1 12/2012 Aranda
2013/0225041 A1 8/2013 Johnson et al.
2013/0308305 A1 11/2013 Arndt et al.
2014/0254158 A1 * 9/2014 Mangus ..... F21V 15/01 362/249.05
2014/0259408 A1 * 9/2014 Morley ..... A47G 9/02 5/502
2014/0311843 A1 10/2014 Grignon et al.
2016/0088953 A1 3/2016 Benezri
2016/0114184 A1 4/2016 Kaestle
2016/0192785 A1 7/2016 Marsocci
2016/0313636 A1 10/2016 Chien
2017/0112295 A1 * 4/2017 McConnell ..... A47D 5/00
2017/0112296 A1 * 4/2017 McConnell ..... A47D 5/00

* cited by examiner

LIGHTED BABY CHANGING PAD

This application claims the benefit of U.S. Provisional Application No. 62/068,121, filed on Oct. 24, 2014, the contents of which are incorporated herein by reference.

FIELD OF THE INVENTION

The present invention generally relates to a baby changing pad, more particularly to a baby changing pad that provides safe, low level illumination.

BACKGROUND OF THE INVENTION

When changing a baby, often the caregiver will lay the baby on a changing pad for the comfort of the baby, and in some instances, to maintain a controlled changing area. Changing pads typically have at least one layer of plush material and a covering layer.

When changing a baby at night in a dark room, it is often necessary to turn on a room light or another light source to enable the caregiver to see what they are doing. If the caregiver has to take a hand away from the attention on the baby in order to turning on a room light or other light source, such may lead to an unsafe situation. Additionally, a bright light illuminating the dark room may startle the baby or otherwise awaken the baby.

SUMMARY OF THE INVENTION

In at least one embodiment, the present invention provides a baby changing pad that includes a safe, low intensity illumination effect that allows a care giver to change a baby's diaper at night with the least disturbance to the baby or the care giver during the process. When the portable battery powered lighting effect built into the changing pad is switched on, the pad provides sufficient low level illumination for changing the soiled diaper and cleaning the baby without needing to turn on bright room lights. The pad preferably illuminates the baby, the area around the baby and the baby diaper changing area for completing the task.

In at least one embodiment, a baby changing pad of the present invention includes an illumination element and a power device required to operate the illumination element.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION OF THE INVENTION

Figure 1:
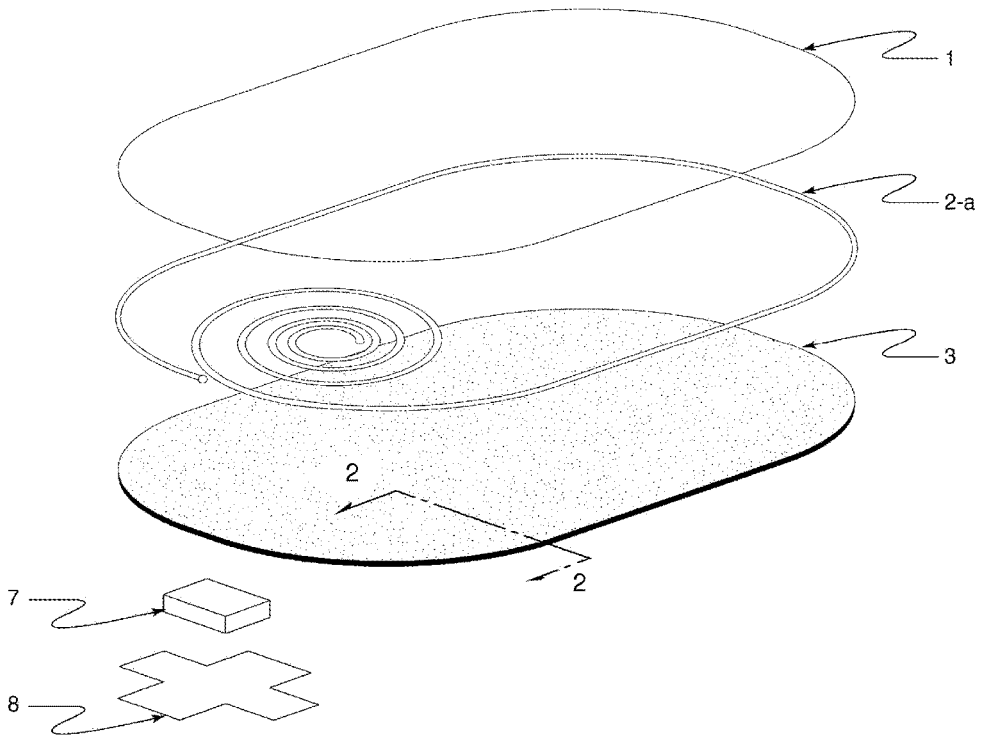
FIG. 1 is an exploded perspective view of an exemplary three layer lighted baby changing pad with an electroluminescent wire in accordance with an embodiment of the invention.
Figure 2:
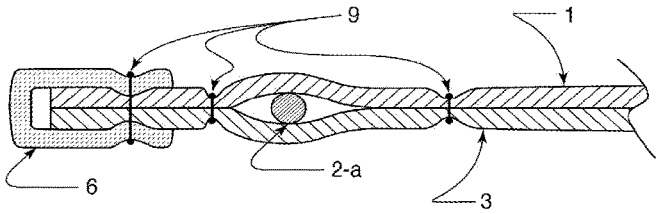
FIG. 2 is a cross-sectional view of the assembled pad of FIG. 1 along the line 2-2.
Figure 3:
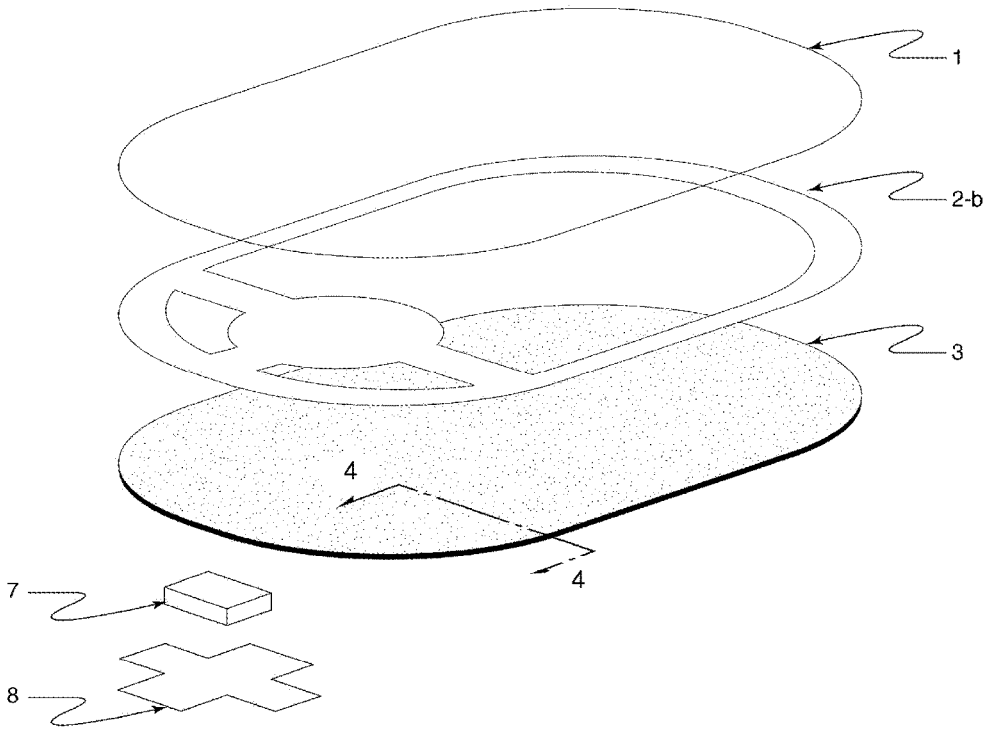
FIG. 3 is an exploded perspective view of an exemplary three layer lighted baby changing pad with an electroluminescent flexible panel in accordance with an embodiment of the invention.
Figure 4:
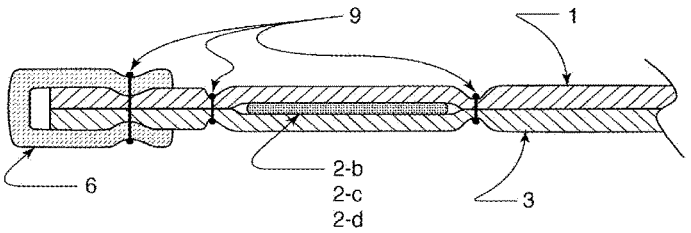
FIG. 4 is a cross-sectional view of the assembled pad of FIG. 3 along the line 4-4.
Figure 5:
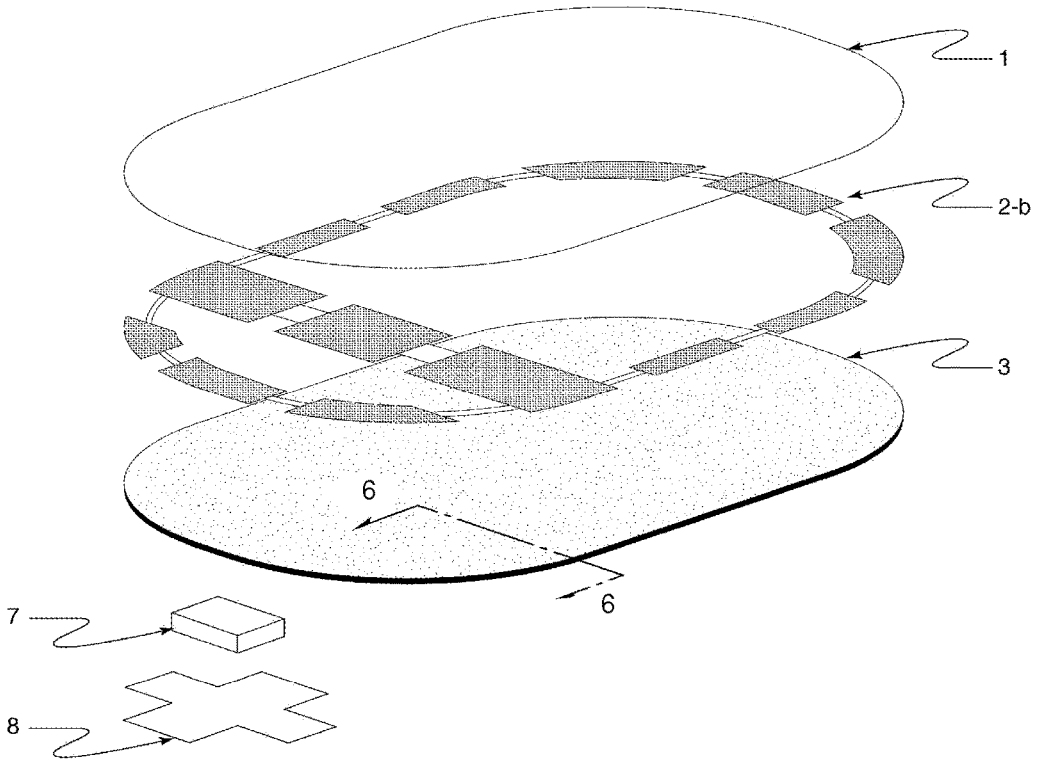
FIG. 5 is an exploded perspective view of an exemplary three layer lighted baby changing pad with an electroluminescent panel in accordance with an embodiment of the invention.
Figure 6:
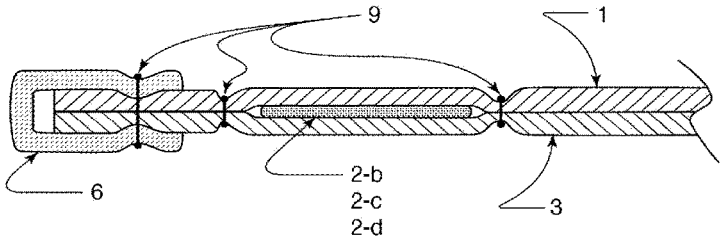
FIG. 6 is a cross-sectional view of the assembled pad of FIG. 5 along the line 6-6.
Figure 7:
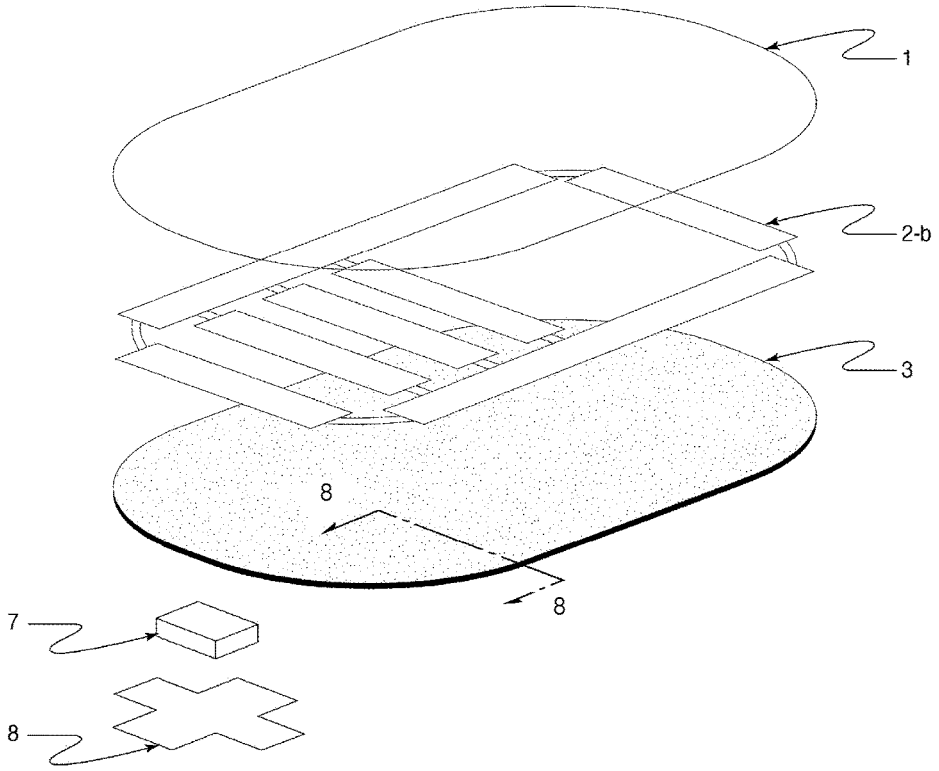
FIG. 7 is an exploded perspective view of an exemplary three layer lighted baby changing pad with an electroluminescent flexible tape in accordance with an embodiment of the invention.
Figure 8:
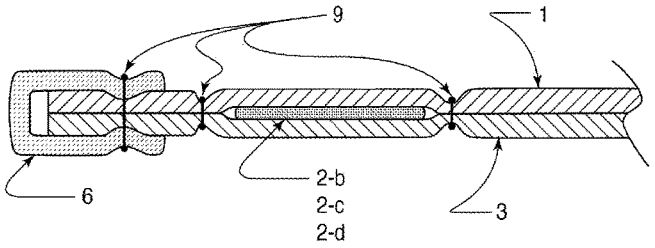
FIG. 8 is a cross-sectional view of the assembled pad of FIG. 7 along the line 8-8.
Figure 9:
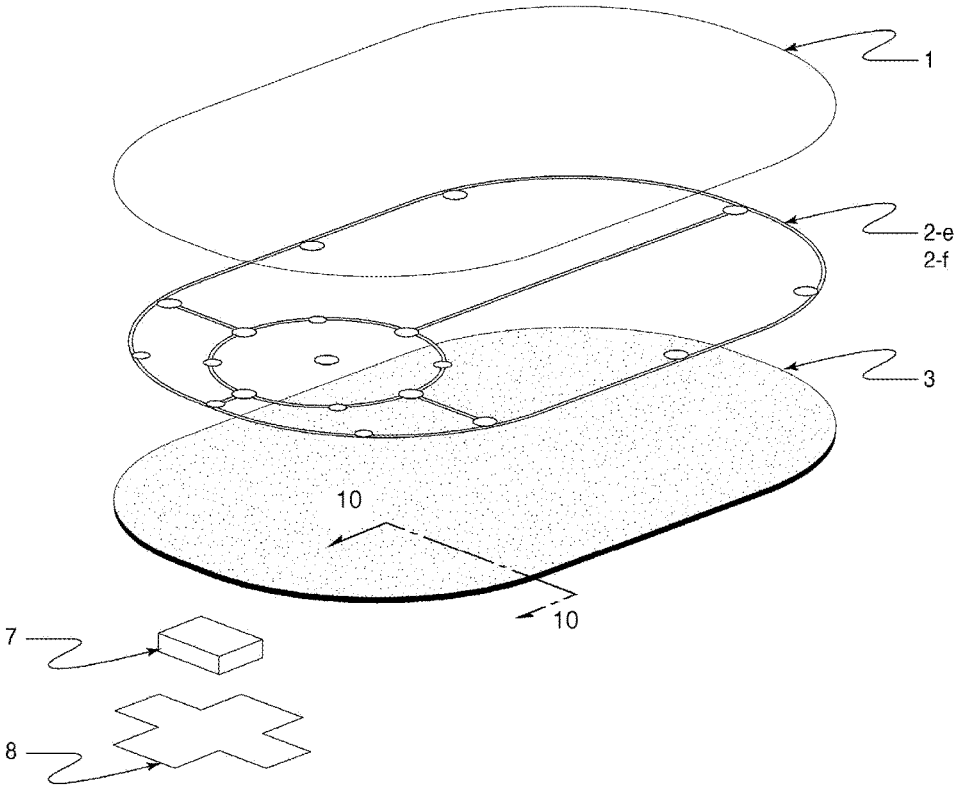
FIG. 9 is an exploded perspective view of an exemplary three layer lighted baby changing pad with LEDs or M-LEDs in accordance with an embodiment of the invention.
Figure 10:
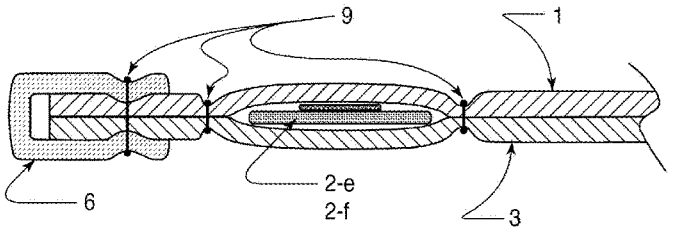
FIG. 10 is a cross-sectional view of the assembled pad of FIG. 9 along the line 10-10.
Figure 11:
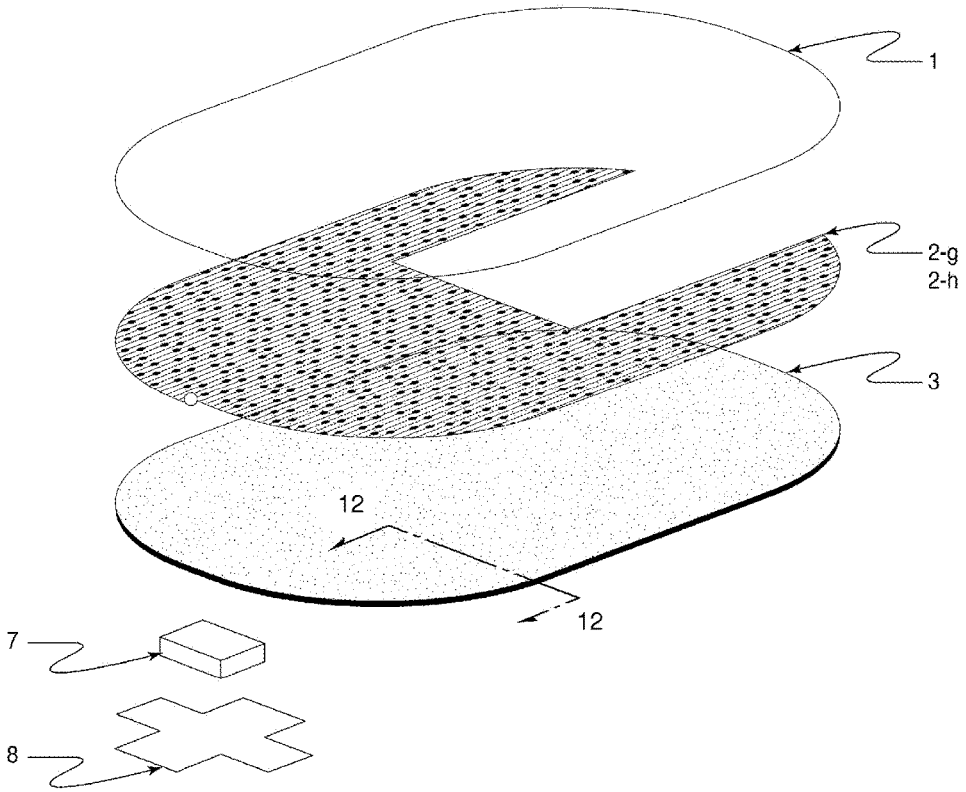
FIG. 11 is an exploded perspective view of an exemplary three layer lighted baby changing pad with fiber optic strands in accordance with an embodiment of the invention.
Figure 12:
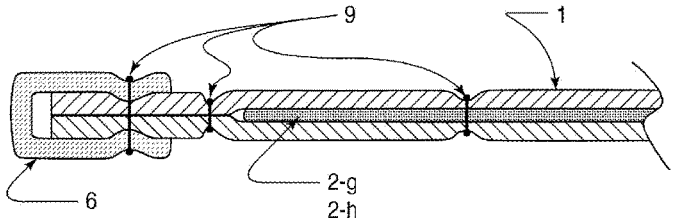
FIG. 12 is a cross-sectional view of the assembled pad of FIG. 11 along the line 12-12.
Figure 13:
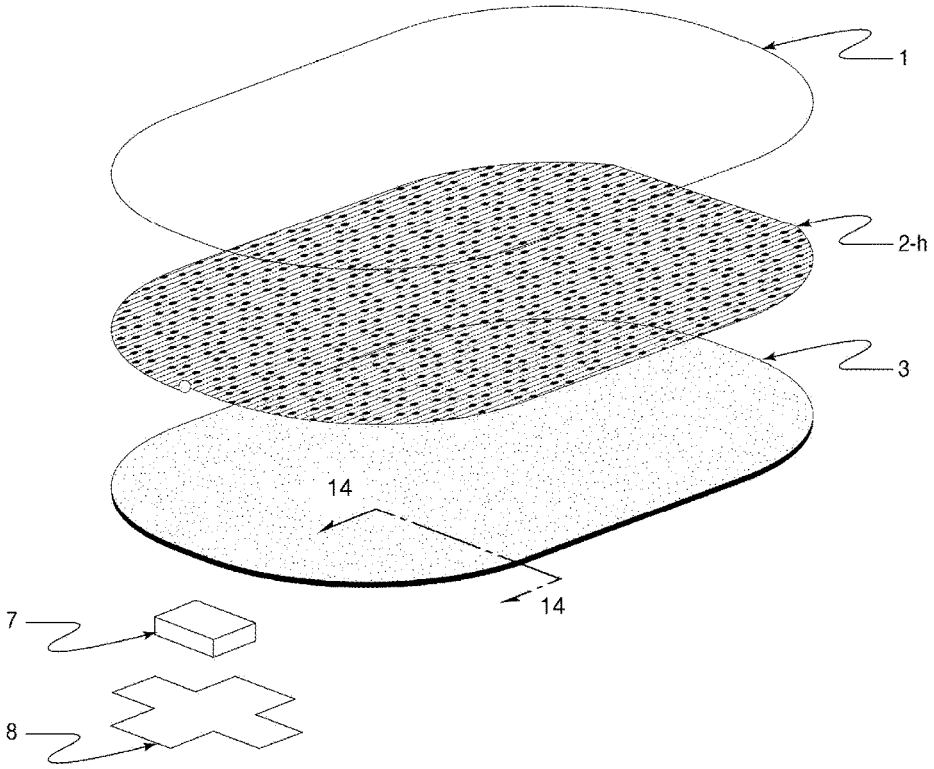
FIG. 13 is an exploded perspective view of an exemplary three layer lighted baby changing pad with fiber optic clothe in accordance with an embodiment of the invention.
Figure 14:
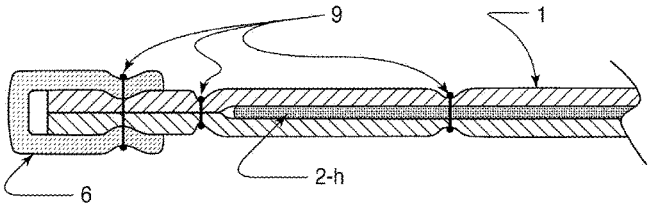
FIG. 14 is a cross-sectional view of the assembled pad of FIG. 13 along the line 14-14.
Figure 15:
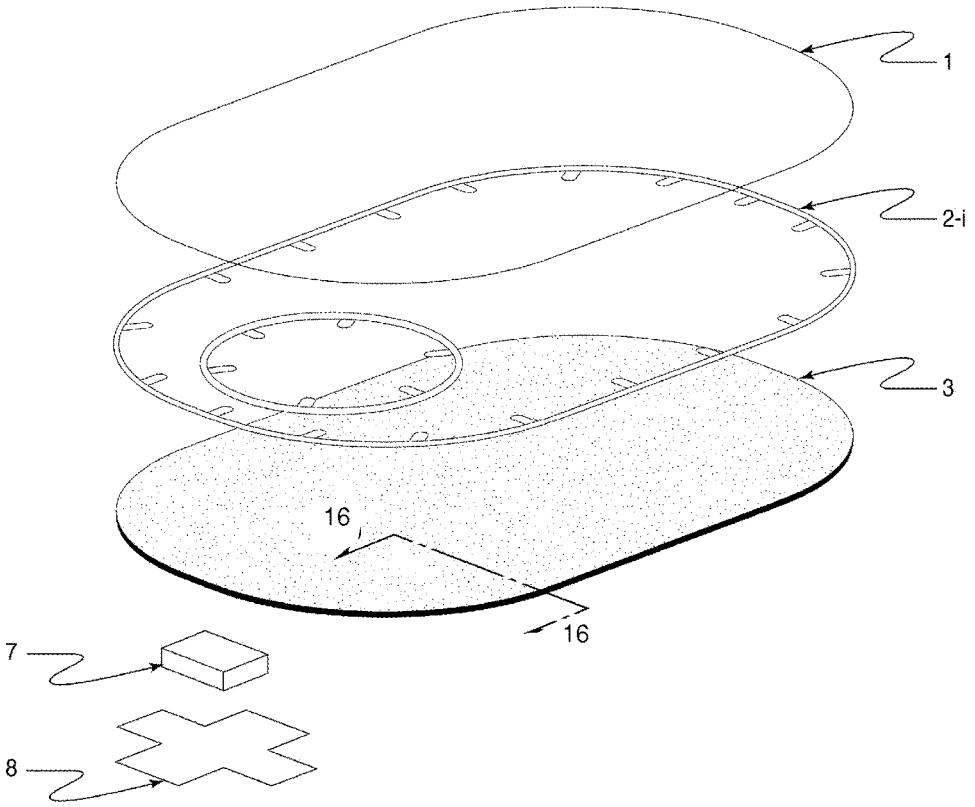
FIG. 15 is an exploded perspective view of an exemplary three layer lighted baby changing pad with miniature incandescent bulbs in accordance with an embodiment of the invention.
Figure 16:
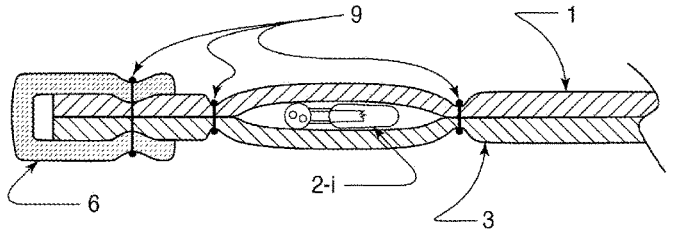
FIG. 16 is a cross-sectional view of the assembled pad of FIG. 15 along the line 16-16.
Figure 17:
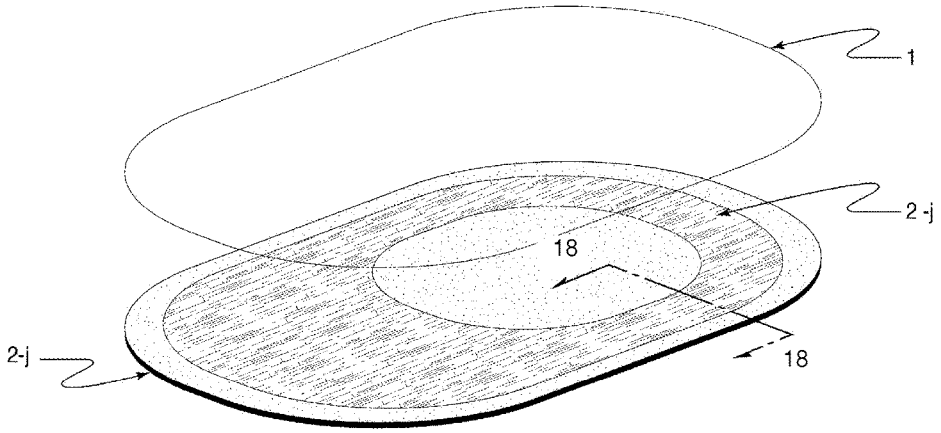
FIG. 17 is an exploded perspective view of an exemplary three layer lighted baby changing pad with phosphorescent glow paint on clothe in accordance with an embodiment of the invention.
Figure 18:
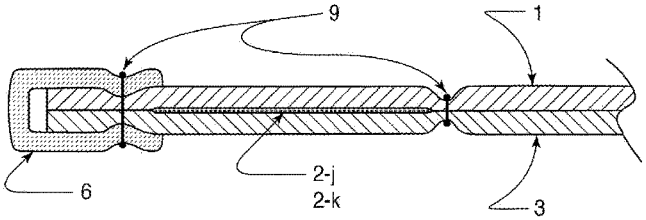
FIG. 18 is a cross-sectional view of the assembled pad of FIG. 17 along the line 18-18.
Figure 19:
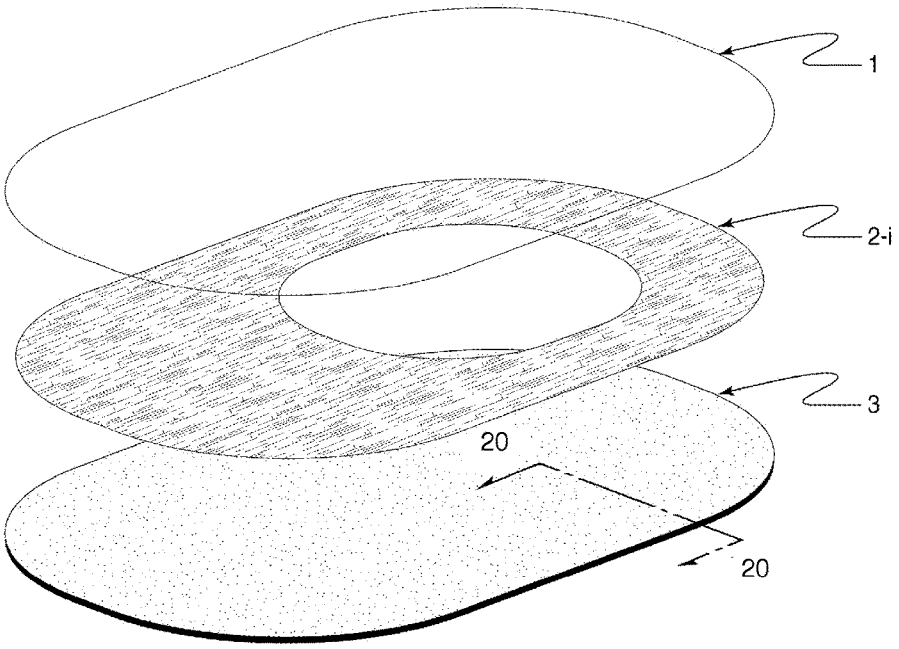
FIG. 19 is an exploded perspective view of an exemplary three layer lighted baby changing pad with phosphorescent glow paint on a flex panel in accordance with an embodiment of the invention.
Figure 20:
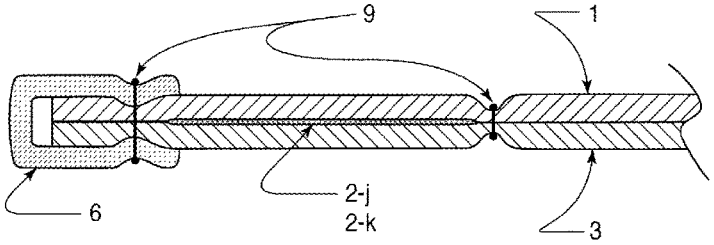
FIG. 20 is a cross-sectional view of the assembled pad of FIG. 19 along the line 20-20.
Figure 21:
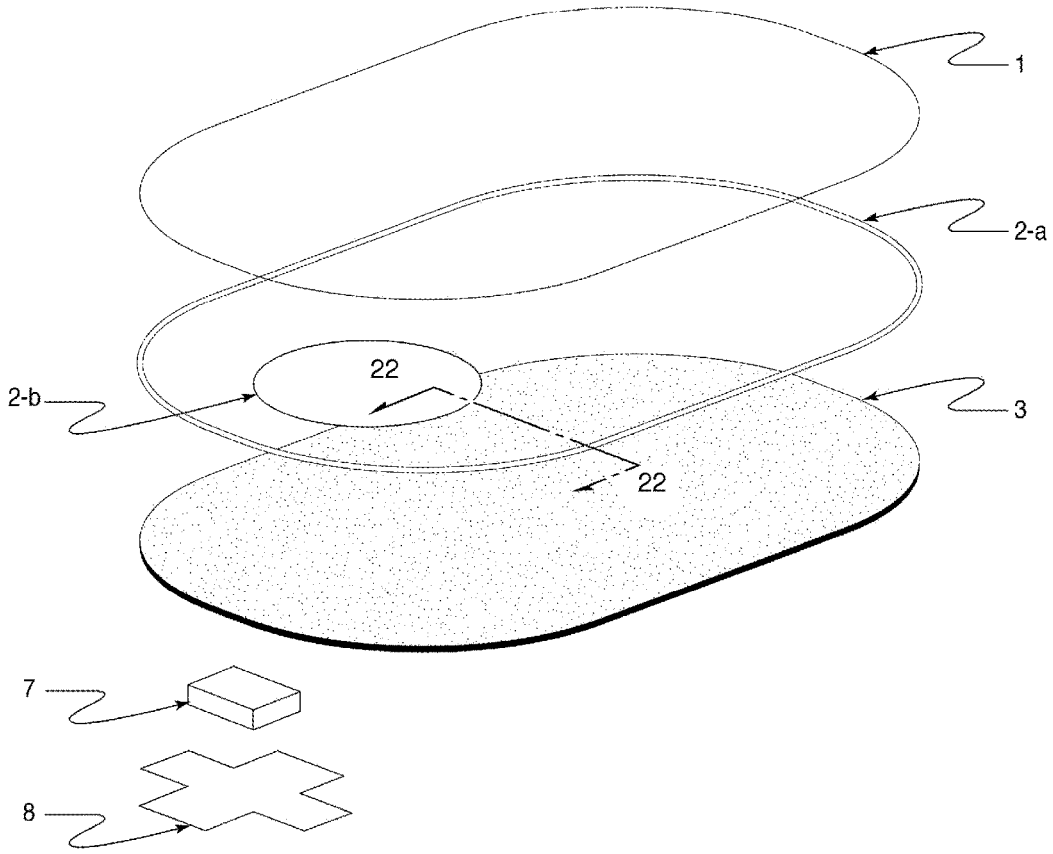
FIG. 21 is an exploded perspective view of an exemplary three layer lighted baby changing pad with electroluminescent wire and an electroluminescent flexible panel in accordance with an embodiment of the invention.
Figure 22:
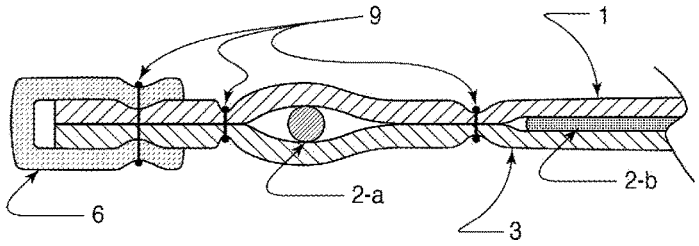
FIG. 22 is a cross-sectional view of the assembled pad of FIG. 21 along the line 22-22.
Figure 23:
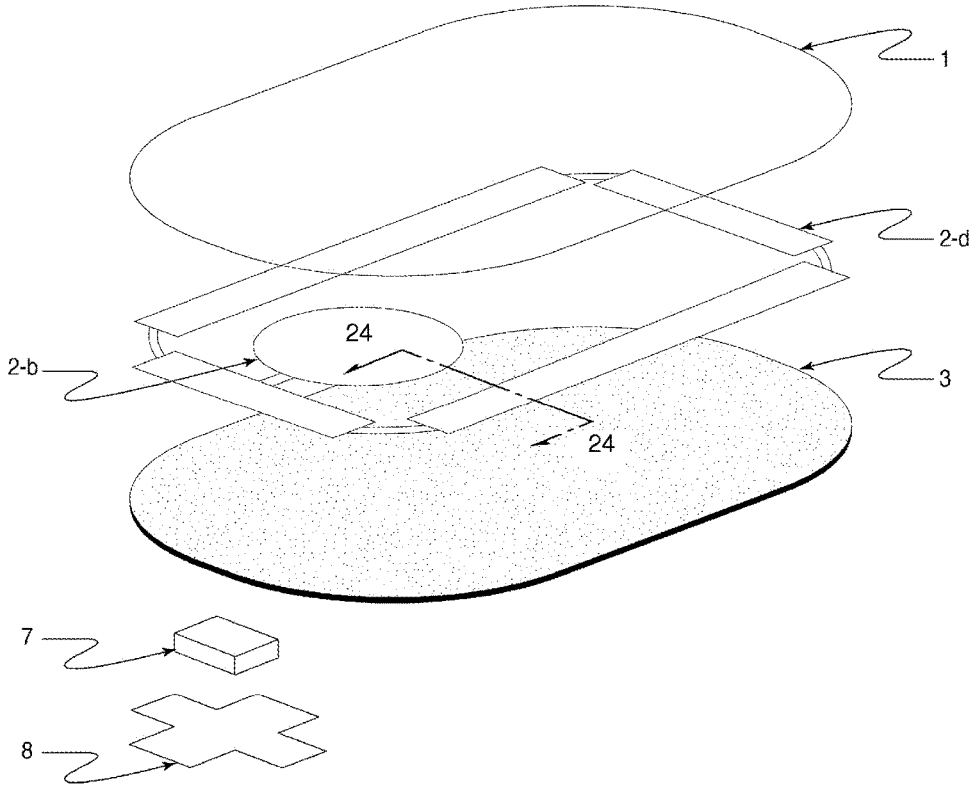
FIG. 23 is an exploded perspective view of an exemplary three layer lighted baby changing pad with electroluminescent tape and an electroluminescent flexible panel in accordance with an embodiment of the invention.
Figure 24:
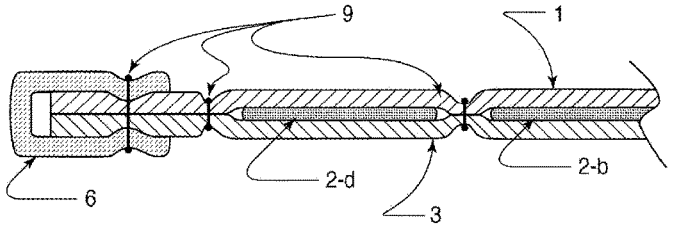
FIG. 24 is a cross-sectional view of the assembled pad of FIG. 23 along the line 24-24.
Figure 25:
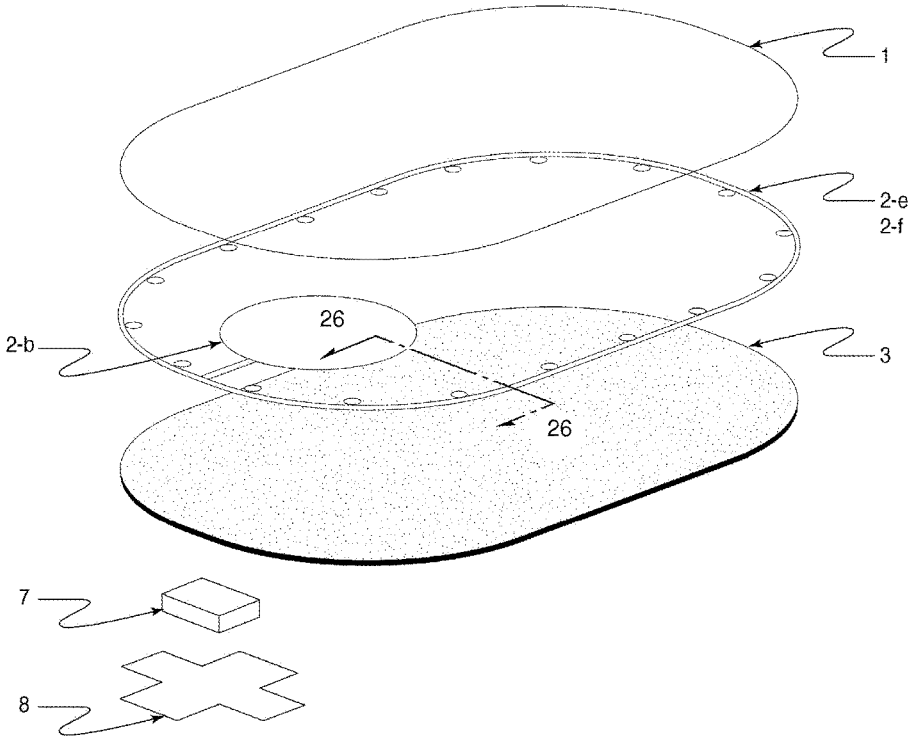
FIG. 25 is an exploded perspective view of an exemplary three layer lighted baby changing pad with LEDs and an electroluminescent flexible panel in accordance with an embodiment of the invention.
Figure 26:
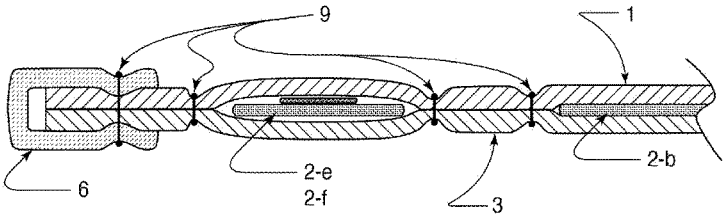
FIG. 26 is a cross-sectional view of the assembled pad of FIG. 25 along the line 26-26.
Figure 27:
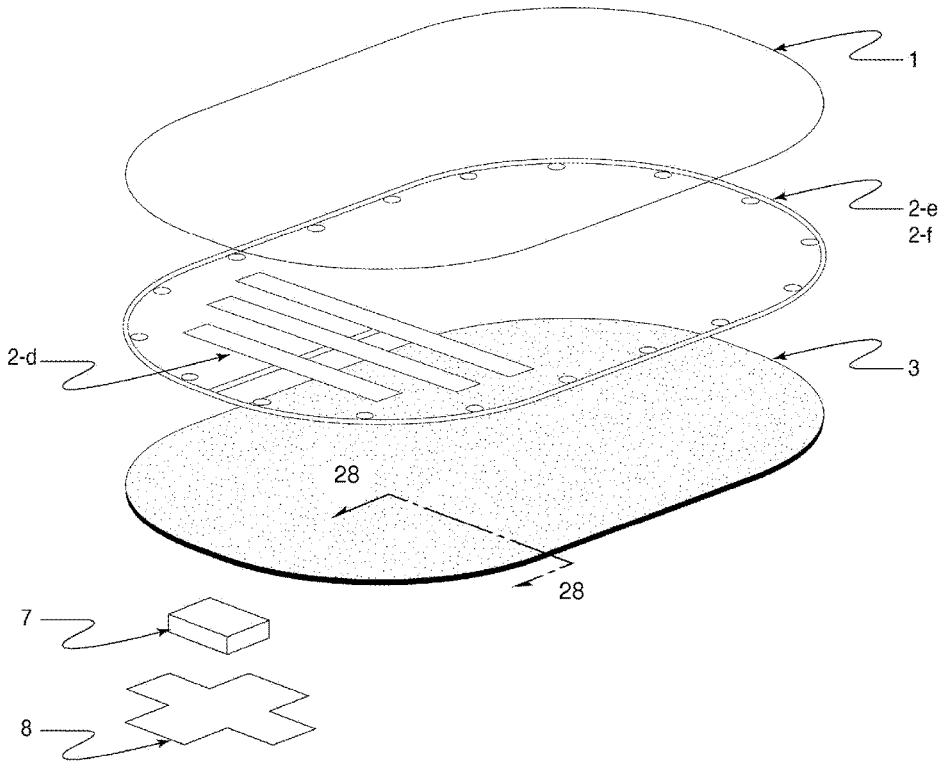
FIG. 27 is an exploded perspective view of an exemplary three layer lighted baby changing pad with LEDs and electroluminescent tape in accordance with an embodiment of the invention.
Figure 28:
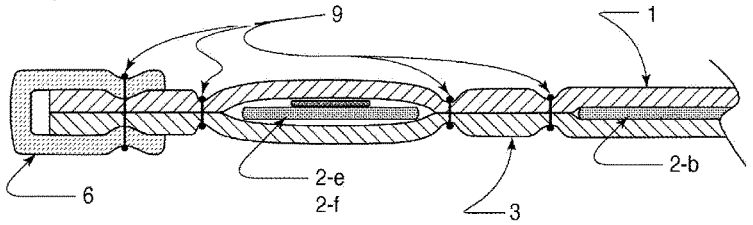
FIG. 28 is a cross-sectional view of the assembled pad of FIG. 27 along the line 28-28.
Figure 29:
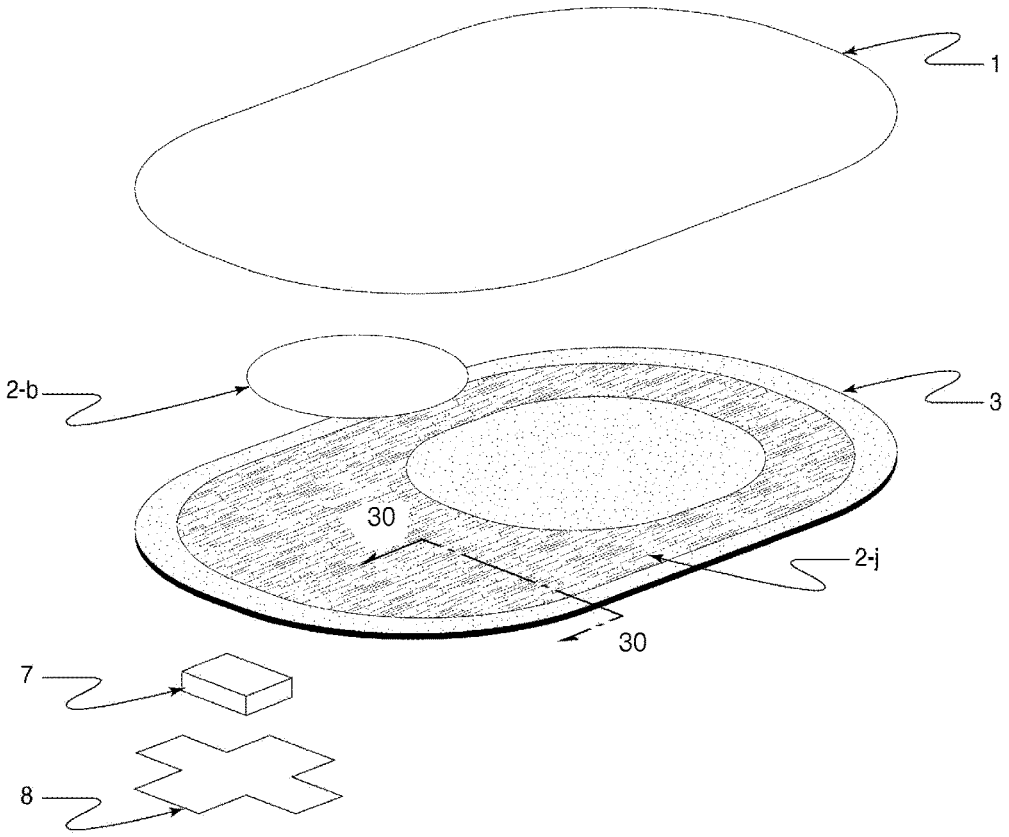
FIG. 29 is an exploded perspective view of an exemplary three layer lighted baby changing pad with phosphorescent glow paint and an electroluminescent flexible panel in accordance with an embodiment of the invention.
Figure 30:
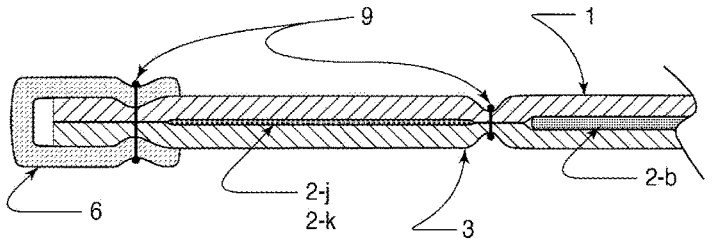
FIG. 30 is a cross-sectional view of the assembled pad of FIG. 29 along the line 30-30.

In the drawings, like numerals indicate like elements throughout. Certain terminology is used herein for convenience only and is not to be taken as a limitation on the present invention. The following describes preferred embodiments of the present invention. However, it should be understood, based on this disclosure, that the invention is not limited by the preferred embodiments described herein.

The following components are used in the various embodiments and described for general understanding.

The top, body contacting layer 1 is generally a clear, frosted, tinted or untinted, continuous sheet or woven light transmitting material, or translucent light transmitting pliable plastic material that will cover the top of the changing pad and allow the light from the lighting device below it to be seen therethrough. The pliable material used is preferably capable of being rolled or folded for storage. The pliable material may be, for example, but are not limited to: polyester, polyethylene, polyvinyl, polystyrene, polypropylene, polycarbonate, polybutylene, polynitrile and others. The pliable material can have ridged and non-ridged sections. The main purpose of the top, body contacting layer 1 is to provide a relatively smooth, cleanable work surface for a small child or baby lie on, to allow the lighting element below the material to be seen and show through the material, to preferably be capable of being rolled or folded for storage and to provide a secondary electrical protection layer for the users from contacting any electrical devices used to power, connect, light or decorate the pad.

The lighting element layer 2 is a term that is interchangeable with the term lighting element device which is positioned below the top, body contacting layer 1 so that light from the lighting device passes through or shows through at least a portion of the top, body contacting layer 1 and the lighting element device is configured to illuminate a baby in contact with the top, body contacting layer 1. The lighting element device 2 is strategically arranged close to the edge of the pad around the outside edge of the pad to provide general lighting for the edge of the pad and the baby in the center of the pad. Another portion of lighting element device 2 may be arranged in an area of the changing pad to highlight the lower portions of the baby and the baby's diaper region. The lighting element device 2 can utilize any portable lighting sources as long as it can be powered with a portable power source such as a standard or rechargeable battery and may be, for example, one or more of the following lighting types: electroluminescent wire 2-*a*, electroluminescent flexible panel 2-*b*, electroluminescent panel 2-*c*, electroluminescent flexible tape 2-*d*, LEDs 2-*e*, M-LEDs 2-*f*, fiber optic strands 2-*g*, fiber optic cloth 2-*h*, miniature incandescent lamps 2-*i*, phosphorescent glow paint 2-*j*, or glow coated material 2-*k*.

The bottom lighting element support layer 3 is positioned below the lighting element layer 2 and provides an encapsulation layer for the lighting elements and the lighting power elements and wiring between the top and bottom layers. The bottom support layer also provides a double insulation safety enclosure for all electrical components and wiring. The bottom support layer 3 can provide a substrate for design elements as well as being a padded material as well as the final outside covering layer. When the changing pad is incorporated with a raised lighted area 3-*a* at the bottom of the pad, this layer may have a relative amount of stiffness to support the raised lighted element. Suggested, but not limited to, materials for this layer are closed cellular foam sheeting, pliable plastic material such as polyester, polyethylene, polyvinyl, polystyrene, polypropylene, polycarbonate, polybutilene, polynitrile and others, coated or uncoated of the following materials: denim, felt or other woven or matted natural or manmade fiber clothe. Coatings include plastic laminate film or sheeting applied to one or both sides of support material or liquid plastic or paint like coatings. The main purpose of the bottom lighting element support layer material is to provide a relatively smooth, cleanable, electrically neutral lighting element support that is preferably capable of being rolled or folded for storage and to provide a secondary electrical protection layer for the users from contacting any electrical devices used to power, connect, light or decorate the pad. A secondary purpose would be to provide some level of padding for the baby on the pad.

An optional padding layer 4 may be included for offering additional comfort to the baby lying on the pad. When an optional padding layer is used, it can be at any layer position below the lighting layer but is preferably placed below the bottom lighting element support layer 3. It will be added to the changing pad for comfort and will be a foam material, felt, rubber or other padding material or quilted material for use in cushioning the baby on the pad.

An optional backing layer 5 may be included for offering additional decorative effects or additional cover for protecting the bottom layers from moisture. Suggested, but not limited to, materials for this layer are closed cellular foam sheeting, pliable plastic material such as polyester, polyethylene, polyvinyl, polystyrene, polypropylene, polycarbonate, polybutylene, polyntrile and others, coated or uncoated of the following materials: denim, felt or other woven or matted natural or manmade fiber cloth. Coatings include plastic laminate film or sheeting applied to one or both sides of support material or liquid plastic or paint like coatings. The main purpose of the optional backing layer material is to provide a relatively smooth, cleanable, layer that is capable of being rolled or folded for storage and to provide a decorative surface for the pad. A secondary purpose would be to provide some level of padding for the baby on the pad.

Optional edge binding 6 may be included to finish and hold the changing pad layer edges together in a finished binding look. The edge binding 6 can be a separate piece of edge binding material fastened or sewn to the pad or it can be an edge wrap sewing stitch to keep edges together and prevent fraying. It can also be an extended portion of the top or bottom layer wrapped around the other layers to give the finished look. When the changing pad is incorporated with an optional edge binding, suggested, but not limited to, materials for this component are pliable plastic material such as polyester, polyethylene, polyvinyl, polystyrene, polypropylene, polycarbonate, polybutylene, polynitrile and others, coated or uncoated of the following materials: denim, felt or other woven or matted natural or manmade fiber cloth. Coatings may include plastic laminate film or sheeting applied to one or both sides of support material or liquid plastic or paint like coatings. When the raised section of the pad with the lighting element device is used a clear, frosted, tinted or non-tinted light transmitting material, or translucent light transmitting pliable plastic material that will be used in the raised area for the edge binding and holding the lighting element to the lighted baby changing pad.

A battery power pack 7, with or without an inverter circuit, is used to power the lighting element device. A plastic housing holds the one or more portable power devices such as disposable or rechargeable batteries as well as an electronic circuit required to illuminate some lighting elements or provide other features to the changing pad. The power pack can have a range of controls such as an on/off control switch, an optional recharger input, an optional dimmer control, an optional proximity "on" sensor and an optional timer shutoff. The inverter circuit is required to operate the electroluminescent lighting devices. It is an electrical circuit that changes the battery power from dc to ac and increases the voltage to light the electroluminescent lighting devices.

The battery/inverter power pack support and changing pad attachment 8 holds the battery/inverter power pack 7 to the changing pad. It allows easy access to the power pack on/off control switch, the optional recharger input, other optional controls and easy removal to replace batteries for the non-rechargeable power packs. The battery/inverter power pack support also provides a secondary electrical protection layer for the users from contacting any electrical components used to power, connect, light or decorate the pad. The battery/inverter power pack support can be separate piece attached to the pad or an extension of an existing layer like the top, body contacting layer or the bottom support layer. Suggested, but not limited to, materials for this component is a pliable plastic material such as polyester, polyethylene, polyvinyl, polystyrene, polypropylene, polycarbonate, polybutylene, polyntrile and others.

A fastener or process 9 is utilized to hold together all changing pad layers, edge bindings and battery/inverter power pack support and changing pad attachments, for example, by sewing, ultrasonically welding, gluing, adhesive transfer, hook and loop attachment, mechanical riveting, eye letting fasteners, clothing snaps, clothing hooks, buttoning or a combination of these processes in such a way that the changing pad layers are held together holding the lighting elements permanently in a position around the changing pad outside edge and in the desired location inside the changing pad to light the baby changing area.

With reference to FIGS. 1-20, various embodiments of a three layer lighted baby changing pad with a single type of illumination source will be described.

The lighted baby changing pad in these embodiments is a three layer sandwich consisting of a top body contacting layer 1 as described above, a lighting element layer 2 positioned below the top, body contacting layer 1 and above the bottom lighting element support layer 3.

Using one of the fasteners or fastening processes 9, the layers are fastened together in such a way that the lighting element 2 is positioned between the top layer 1 and the bottom layer 3. The fastener or fastening process 9 also positions the lighting element 2 around the outside of the changing pad and in other strategic locations for illuminating the baby, the area around the baby and baby diaper changing area.

In the embodiments illustrated in FIGS. 1-20, a portable lighting element device 2, such as an electroluminescent wire 2-*a*, electroluminescent flexible panel 2-*b*, electroluminescent panel 2-*c*, electroluminescent flexible tape 2-*d*, LEDs 2-*e*, M-LEDs 2-*f*, fiber optic strands 2-*g*, fiber optic clothe 2-*h*, miniature incandescent lamps 2-*i*, phosphorescent glow paint 2-*j*, or glow coated material 2-*k*, is positioned and held in location by the fastening process 9 in such a way that the lighting element 2 illuminates the outer edge of the changing pad and a more concentrated area near the bottom of the changing pad close to the baby diaper changing area.

A battery pack power unit 7, with a power inverter when required for some lighting elements, is used to power the lighting element device 2. The power pack 7 is attached to the changing pad by the power pack support and changing pad attachments 8 and the fastening process 9. The power pack 7 is connected to the lighting elements 2 through wire leads or other commercially available electrical connecting devices with or without electrical connectors.

With reference FIGS. 21-30, various embodiments of a three layer lighted baby changing pad with more than one type of portable illumination source will be described.

The lighted baby changing pad in these embodiments is a three layer sandwich consisting of a top body contacting layer 1 as described above, a lighting element layer 2 positioned below the top, body contacting layer 1 and above the bottom lighting element support layer 3.

The lighted baby changing pad in these embodiments is an example of a lighted baby changing pad where more than one type of portable lighting element device 2 is used to light a baby changing pad. The embodiment illustrated in FIGS. 21 and 22 uses an electroluminescent wire 2-*a* that is positioned around the outside edge of the changing pad and an electroluminescent flexible panel 2-*b* that is positioned in the area illuminating the baby diaper changing area. Various combinations of lighting elements, such as electroluminescent wire 2-*a*, electroluminescent flexible panel 2-*b*, electroluminescent panel 2-*c*, electroluminescent flexible tape 2-*d*, LEDs 2-*e*, M-LEDs 2-*f*, fiber optic strands 2-*g*, fiber optic clothe 2-*h*, miniature incandescent lamps 2-*i*, phosphorescent glow paint 2-*j*, or glow coated material 2-*k*, may be utilized, including those illustrated in FIGS. 23-30.

Using one of the fasteners or fastening processes 9, the layers are fastened together in such a way that the lighting element 2 is positioned between the top layer 1 and the bottom layer 3 The fastener or fastening process 9 also positions the multiple lighting elements 2-*a* through 2-*h* to the changing pad in strategic locations for illuminating the baby, the area around the baby and the baby diaper changing area.

A battery/inverter power pack 7 is used to power the lighting element devices 2. A battery/power pack 7 is attached to the changing pad by the power pack support and changing pad attachments 8 using the fastener or fastening process 9. The power pack 7 is connected to the lighting elements 2 through wire leads or other commercially available electrical connecting devices with or without electrical connectors. The connecting wires are left out of the illustration figures to simplify the illustrations.

With reference to FIGS. 31-34, various embodiments of four or five layer lighted baby changing pad with single or multiple illumination sources will be described.

The lighted baby changing pad of these embodiments is a four or five layer sandwich consisting of a top body contacting layer 1 as described above, a lighting element layer 2 positioned below the top, body contacting layer 1 and above the bottom lighting element support layer 3, the optional padding layer 4 and an optional decorative layer 5.

Figure 31:
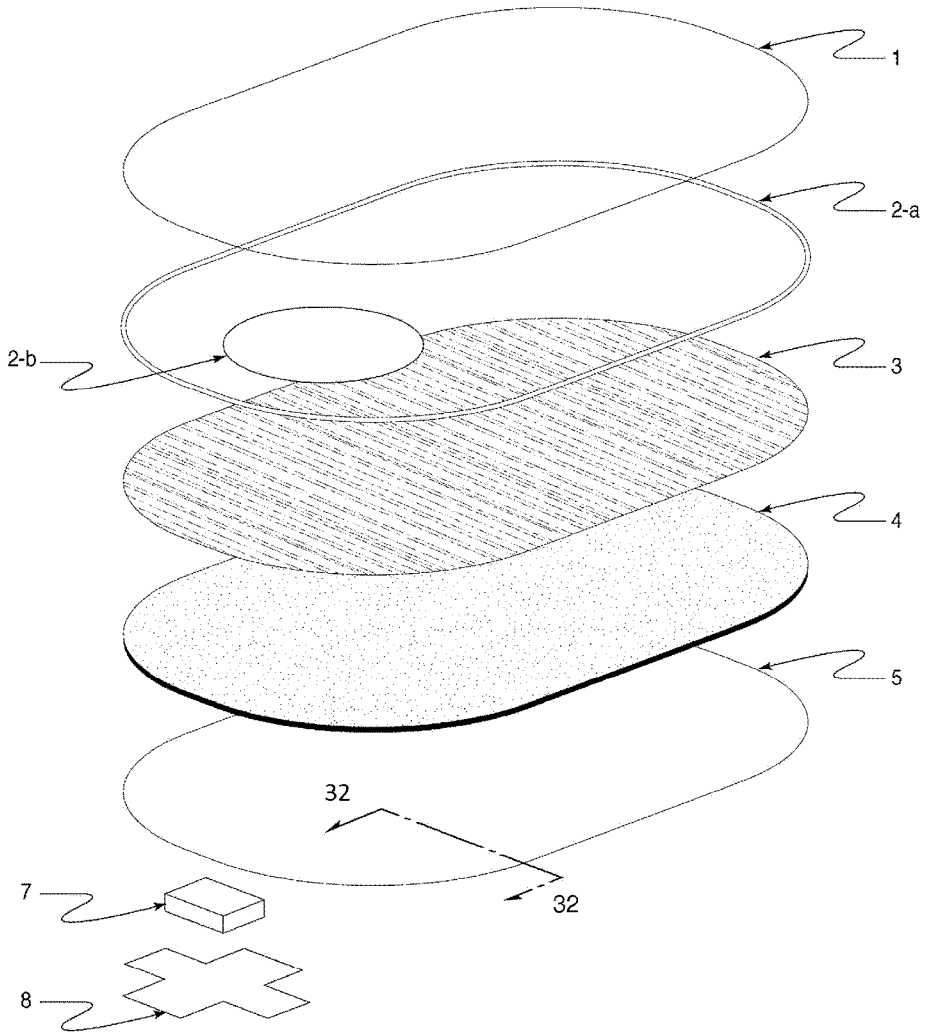
FIG. 31 is an exploded perspective view of an exemplary five layer lighted baby changing pad with electroluminescent wire and an electroluminescent flexible panel and further including an optional padding layer and an optional decorative layer in accordance with an embodiment of the invention.
Figure 32:
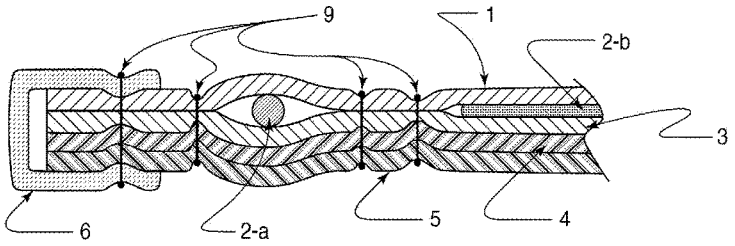
FIG. 32 is a cross-sectional view of the assembled pad of FIG. 31 along the line 32-32.
Figure 33:
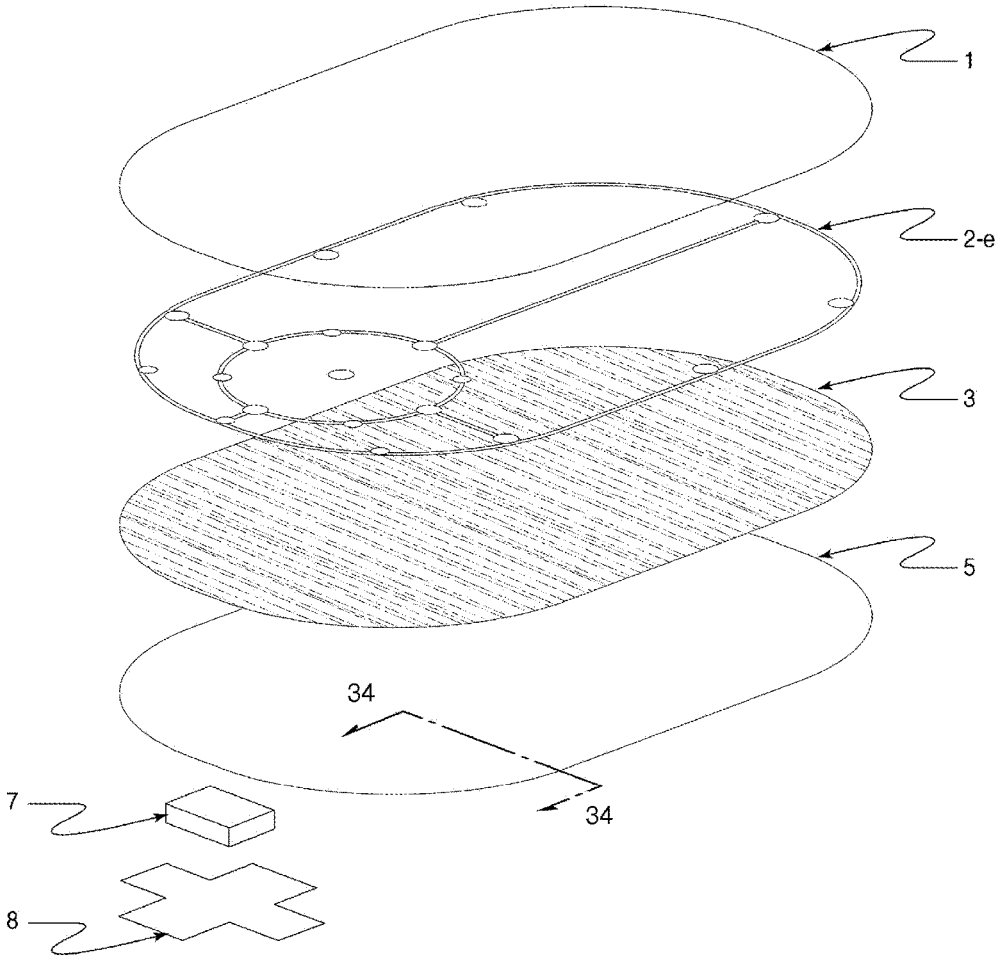
FIG. 33 is an exploded perspective view of an exemplary four layer lighted baby changing pad with LEDs and further including an optional decorative layer in accordance with an embodiment of the invention.
Figure 34:
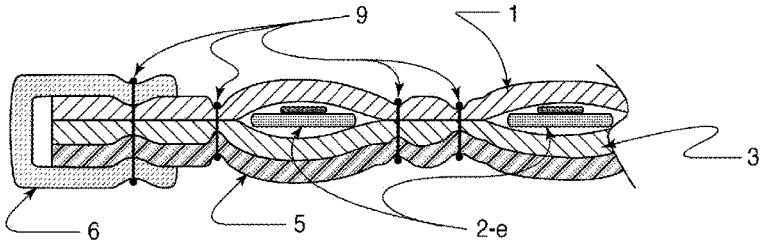
FIG. 34 is a cross-sectional view of the assembled pad of FIG. 33 along the line 34-34.

FIGS. 31-32 illustrate an example of a more complex lighted baby changing pad construction where more than three layers are used in the baby changing pad offering an optional padding layer 4 and an optional decorative layer 5 and more than one type of portable lighting element device 2. This example utilizes an electroluminescent wire 2-*a* that is positioned around the outside edge of the changing pad and an electroluminescent flexible panel 2-*b* that is positioned in the area illuminating the baby diaper changing area. FIGS. 33-34 illustrate another embodiment of a lighted baby changing pad with a single lighting element device of LEDs 2-*e* or M-LEDs 2-*f* and an optional decorative layer 5.

Using one of the fasteners or fastening processes 9, the layers are fastened together in such a way that the lighting element 2 is positioned between the top layer 1 and the bottom layer 3. The fasteners or fastening process 9 also positions the multiple lighting elements 2-*a* through 2-*j* to the changing pad in strategic locations for illuminating the baby, the area around the baby and the baby diaper changing area.

A battery/inverter power pack 7 is used to power the lighting element devices 2. A battery/power pack 7 is attached to the changing pad by the power pack support and changing pad attachments 8 by the fastener or fastening process 9. The power pack 7 is connected to the lighting elements 2 through wire leads or other commercially available electrical connecting devices with or without electrical connectors.

With reference to FIGS. 35-40, various embodiments of a three layer lighted baby changing pad with a single or multiple illumination source and raised section of the pad with the lighting element device will be described.

The lighted baby changing pad in these embodiments is a three layer sandwich consisting of a top body contacting layer 1 as described above, a lighting element layer 2 positioned below the top, body contacting layer 1 and above the bottom lighting element support layer 3. The lighted baby changing pad also has a raised section of pad with the lighting element device to provide improved lighting to the baby changing area.

Figure 35:
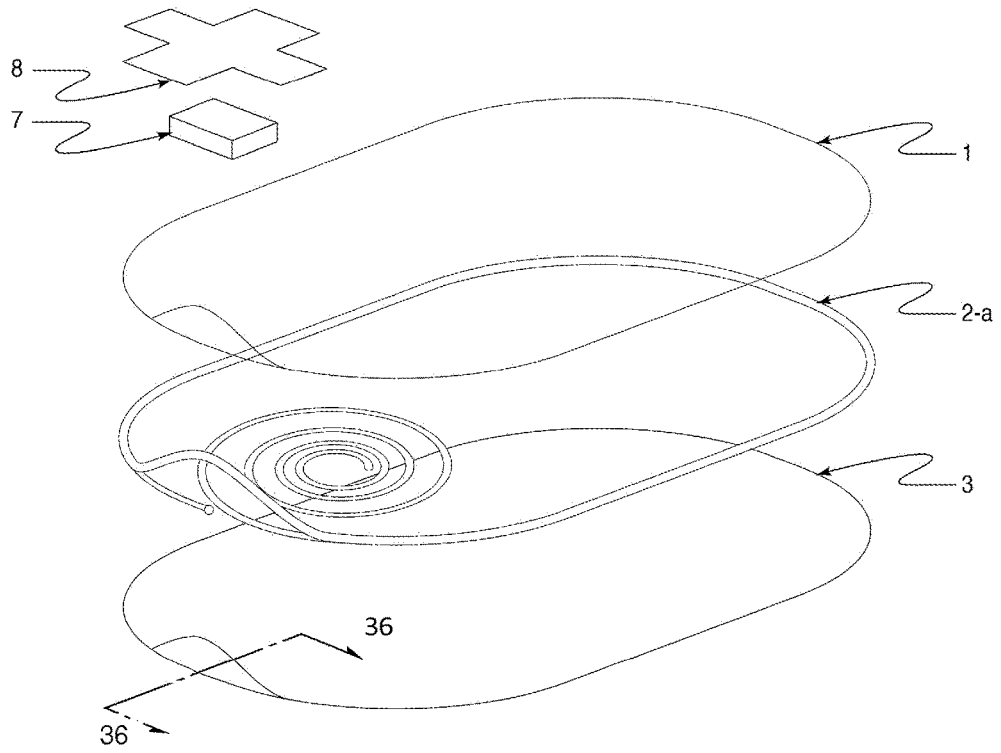
FIG. 35 is an exploded perspective view of an exemplary three layer lighted baby changing pad with a raised section and including electroluminescent wire in accordance with an embodiment of the invention.
Figure 36:
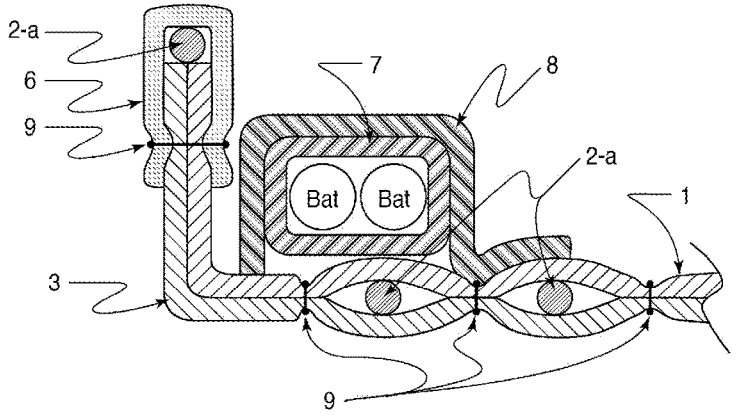
FIG. 36 is a cross-sectional view of the assembled pad of FIG. 35 along the line 36-36.
Figure 37:
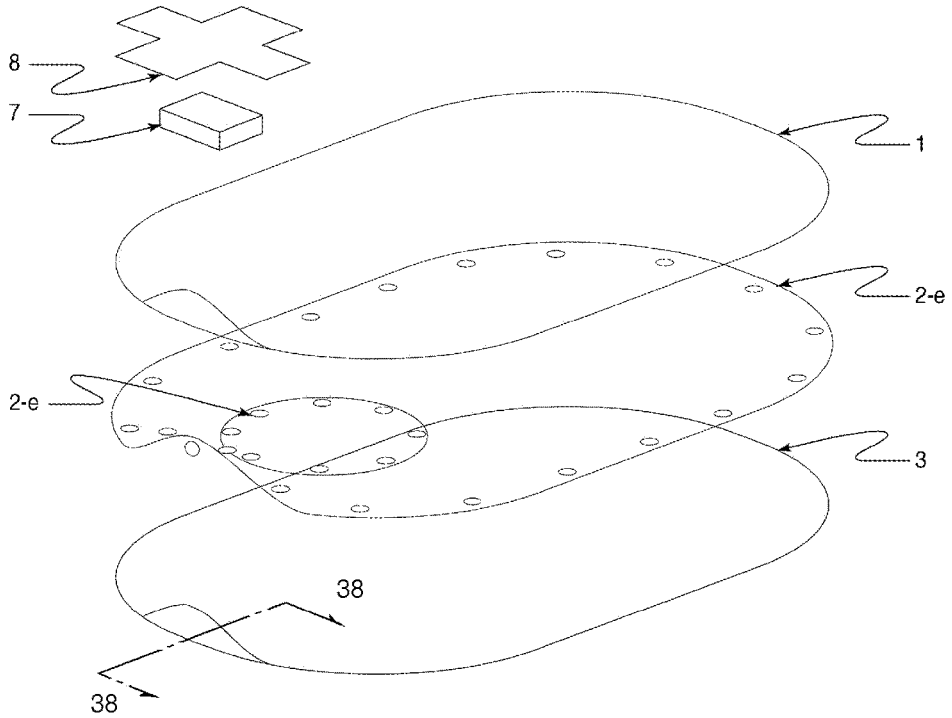
FIG. 37 is an exploded perspective view of an exemplary three layer lighted baby changing pad with a raised section and including LEDs in accordance with an embodiment of the invention.
Figure 38:
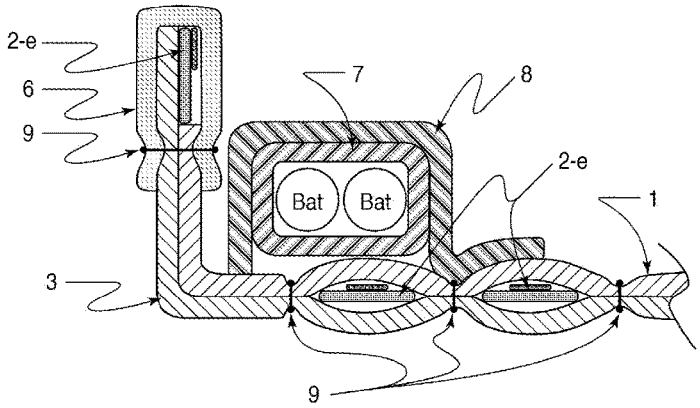
FIG. 38 is a cross-sectional view of the assembled pad of FIG. 37 along the line 38-38.
Figure 39:
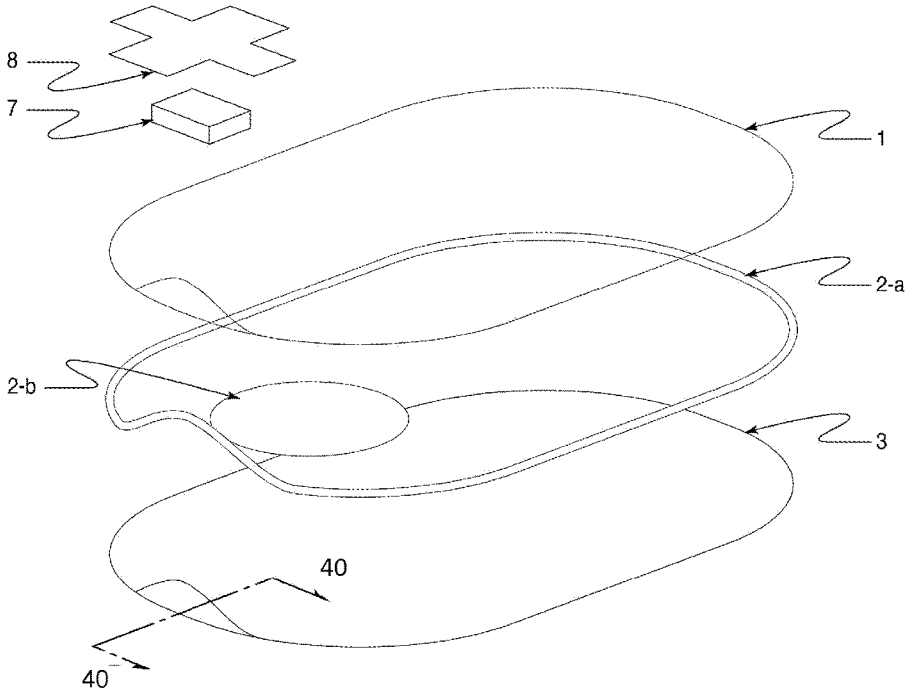
FIG. 39 is an exploded perspective view of an exemplary three layer lighted baby changing pad with a raised section and including electroluminescent wire and an electroluminescent flexible panel in accordance with an embodiment of the invention.
Figure 40:
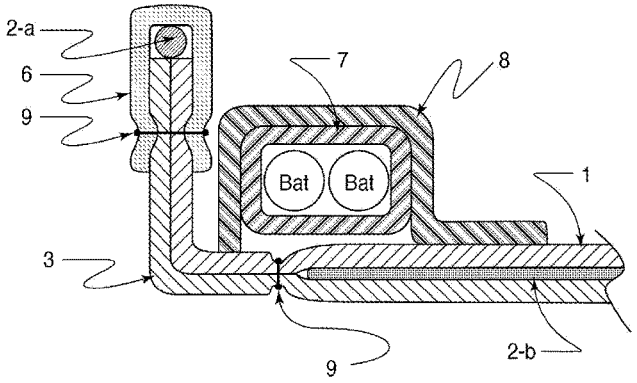
FIG. 40 is a cross-sectional view of the assembled pad of FIG. 39 along the line 40-40.

One example of this raised section of pad with the lighting element device is illustrated in FIGS. 35-36 and uses an electroluminescent wire 2-*a* that is positioned around the outside edge of the changing pad and is raised where the pad is raised to position extra illumination in the baby diaper changing area. Any of the portable lighting element devices can be used to provide the raised illumination effect in the baby diaper changing area.

Using one of the fastener or fastening processes 9, the layers are fastened together in such a way that the lighting element 2 is positioned between the top layer 1 and the bottom layer 3. The fasteners or fastening process 9 also positions the single or multiple lighting elements 2-*a* through 2-*h* to the changing pad in strategic locations for illuminating the baby and the baby diaper changing area.

A battery/inverter power pack 7 is used to power the lighting element devices 2. A battery/power pack 7 is attached to the changing pad by the power pack support and changing pad attachments 8 by the fastening process 9. The power pack 7 is connected to the lighting elements 2 through wire leads or other commercially available electrical connecting devices with or without electrical connectors.

These and other advantages of the present invention will be apparent to those skilled in the art from the foregoing specification. Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as defined in the claims.

What is claimed is:

1. A lighted baby changing pad comprising:

a top, body contacting layer having a central region and a pair of respective end regions, wherein at least a portion of the top, body contacting layer is formed of a light transmitting material;

a bottom support layer having a central region and a pair of respective end regions substantially aligned with the pair of respective end regions of the top, body contacting layer, wherein at least a portion of the bottom support layer is formed of a padded material; and at least one lighting element having a first portion positioned between the top, body contacting layer and the bottom support layer at a location between one of the respective end regions of the top, body contacting layer and the bottom support layer and the respective central regions of the top, body contacting layer and the bottom support layer, wherein the at least one lighting element is configured to transmit light through the light transmitting material toward a lower body portion of a baby placed on the top, body contacting layer, and further wherein at least a second portion of the at least one lighting element is raised relative to at least a portion of the top, body contacting layer and the bottom support layer to provide improved lighting to the lower body portion of the baby placed on the top, body contacting layer.

2. The lighted baby changing pad according to claim 1, wherein the at least one lighting element includes one or more of the following lighting sources: electroluminescent wire, electroluminescent tape, electroluminescent flexible panel, electroluminescent panel, LEDs, M-LEDs, miniature incandescent lamps, fiber optic strands, fiber optic cloth, glow painted on flexible clothe or glow painted on flexible substrate.

3. The lighted baby changing pad according to claim 1, wherein at least a portion of the top, body contacting layer is made from one or more of the following materials: polyester, polyethylene, polyvinyl, polystyrene, polypropylene, polycarbonate, polybutylene, polynitrile and others.

4. The lighted baby changing pad according to claim 1, wherein the top, body contacting layer is pliable.

5. The lighted baby changing pad according to claim 1, wherein the top, body contacting layer includes ridged and non-ridged sections.

6. The lighted baby changing pad according to claim 1, wherein at least a portion of the bottom support layer is made from one or more of the following materials: closed cellular foam sheeting, pliable plastic sheet material such as polyester, polyethylene, polyvinyl, polystyrene, polypropylene, polycarbonate, polybutylene, polynitrile, coated or uncoated of the following materials: denim, felt, canvas or other woven, matted or quilted natural or man-made fiber clothe.

7. The lighted baby changing pad according to claim 1, further comprising a portable power source configured to power the at least one lighting element, wherein the portable power source includes at least one battery.

8. The lighted baby changing pad according to claim 7, wherein the at least one battery is housed within a battery power supply pack, and further wherein a battery power supply pack support is used for attaching the battery power supply pack to the changing pad.

9. The lighted baby changing pad according to claim 8, wherein the battery power supply pack support is a part of the top, body contacting layer or a separate piece attached to the changing pad.

10. The lighted baby changing pad according to claim 1, wherein the at least one lighting element contains two or more similar or different lighting elements.

11. The lighted baby changing pad according to claim 1, wherein the lighted baby changing pad has at least one additional layers for the purpose of at least one of padding the changing pad for comfort and for decorating the changing pad to appeal to users.

12. The lighted baby changing pad according to claim 1, wherein the light transmitting material forming at least a portion of the top, body contacting layer is a clear material.

13. The lighted baby changing pad according to claim 1, wherein the light transmitting material forming at least a portion of the top, body contacting layer is a translucent material.

14. The lighted baby changing pad according to claim 1, further comprising at least one fastener configured to hold the top, body contacting layer together with the bottom support layer.

15. A changing pad assembly comprising:

a top covering portion, wherein the top covering portion comprises a first end region corresponding to a location of an upper body portion of a baby laid atop the top covering portion and a second end region corresponding to a location of a lower body portion of the baby laid atop the top covering portion, wherein the top covering portion at least partially comprises a light transmitting material;

a bottom support portion comprising first and second end regions substantially aligned with the first and second end regions of the top covering portion, wherein the bottom support portion is configured to be at least partially covered by the top covering portion; and at least one lighting element device having a first portion positioned between the top covering portion and the bottom support portion at a location between the respective first end regions and the second end regions of the top covering portion and the bottom support portion, wherein the at least one lighting element device is configured to transmit light through the light transmitting material toward the lower body portion of the baby laid atop the top covering portion, wherein at least a second portion of the at least one lighting element device is raised relative to at least a portion of the top covering portion and the bottom support portion to provide improved lighting from the at least one lighting element device to the lower body portion of the baby laid atop the top covering portion.

16. The changing pad assembly according to claim 15, wherein the bottom support portion comprises a padded material.

17. The changing pad assembly according to claim 15, wherein the at least one lighting element device includes one or more of the following lighting sources: electroluminescent wire, electroluminescent tape, electroluminescent flexible panel, electroluminescent panel, LEDs, M-LEDs, miniature incandescent lamps, fiber optic strands, fiber optic cloth, glow painted on flexible cloth, or glow painted on flexible substrate.

18. The changing pad assembly according to claim 15, further comprising at least one fastener configured to hold the top covering portion together with the bottom support portion.

19. The changing pad assembly according to claim 15, wherein the light transmitting material forming at least a portion of the top covering portion is a clear material.

* * * * *